United States Patent [19]

Weisner et al.

[11] Patent Number: 4,472,299

[45] Date of Patent: Sep. 18, 1984

[54] GENERATOR FOR RADIONUCLIDE AND PROCESS OF USE THEREOF

[75] Inventors: Peter S. Weisner; Terence R. F. Forrest, both of Amersham, England

[73] Assignee: Amersham International plc, Amersham, England

[21] Appl. No.: 367,609

[22] Filed: Apr. 12, 1982

[30] Foreign Application Priority Data

Apr. 24, 1981 [GB] United Kingdom ..... 8112740

[51] Int. Cl.[3] ..... G21G 1/04; C10G 57/00

[52] U.S. Cl. ..... 252/645; 250/432 PD; 422/159; 423/2; 423/6

[58] Field of Search ..... 422/159; 423/6, 7, 2; 250/432 PD; 252/645

[56] References Cited

U.S. PATENT DOCUMENTS 3,564,256 2/1971 Arlman et al. ..... 250/432 PD 3,774,035 11/1973 Litt ..... 250/432 PD 3,774,036 11/1973 Gerhart ..... 250/432 PD X 3,898,044 8/1975 Strecker et al. ..... 422/159

4,296,785 10/1981 Vitello et al. ..... 250/432 PD X

*Primary Examiner*—Barry S. Richman

*Attorney, Agent, or Firm*—Wenderoth, Lind & Ponack

[57] ABSTRACT

A generator of radionuclides such as technetium-99m comprises a generator column (10) containing the radionuclide, a first reservoir (16) for eluent, a second reservoir (18) to contain a volume of the eluent required for a single elution, and a vessel 40 to contain eluate. First, a pre-set volume of eluent is transferred from the first to the second reservoir; then the eluent is sucked from the second reservoir through the column into the eluate vessel. A hydrophobic filter 32 adjacent the second reservoir (18) permits the use of air to dry the column (10) and to bring the partly filled eluate vessel (40) to atmospheric pressure.

10 Claims, 3 Drawing Figures

GENERATOR FOR RADIONUCLIDE AND PROCESS OF USE THEREOF

BACKGROUND OF THE INVENTION

This invention relates to generators for radionuclides of the kind in which a parent radionuclide, adsorbed on a column of particulate material, continuously generates by radioactive decomposition a daughter radionuclide which is periodically removed by elution from the column. This invention is mainly concerned with technetium generators, in which typically the parent radionuclide molybdenum-99 is adsorbed on a column of particulate alumina and the technetium-99m eluted using physiological saline solution. But as will appear, the invention is applicable in principle to generators of any radionuclide.

Originally, separation systems consisted of open glass columns partially filled with ion-exchange material, relying on gravity for the passage of eluent through the bed.

Closed systems, operated either by hand held syringes or by gravity drainage from suspended eluent bags, appeared in the late 1960's. This advance enabled sterile systems to become widely available for clinical applications.

The demand for simple, reliable operation and the increasing size of the market led to more automation. Evacuated or pressurised vials replaced hand pressure and gravity as the driving force behind the elution.

The chemistry of the ion-exchange column and the specific activity of the parent nuclide are paramount in determining the minimum elution volume of a generator. Careful design also plays a part.

Current $^{99m}$Tc generator requirements are for a minimum elution volume of about 5 ml, and existing systems are designed to achieve this as simply as possible.

Some commercially available generators use a single 5 ml evacuated vial and a self-contained reservoir of saline. When connected to an outlet needle, this vial fills by drawing 5 ml of saline from the reservoir and through the column. The column is left wet, which may mean that reagents need to be added to the saline, or incorporated in the column, to ensure that acceptable yields of $^{99m}$Tc are maintained.

Other commercially available generators use charge vials containing predetermined quantities of saline instead of the saline reservoir. In this case connection of the evacuated vial results in the whole of the contents of the charge vial being drawn through the generator into the collection vial. In this latter case the collection vial finally equilibrates to atmospheric pressure by drawing air through the system via a bleed into the charge vial. This so called "double vial" or "dry-bed" elution system requires more operations to be performed by the technician, but does have two advantages over the "single vial" system. These are that the generator bed is aerated, maintaining good yields of $^{99m}$Tc, and that the collection vial contains the eluate at atmospheric pressure and is only partially filled. This last point allows the technician to remove aliquots of solution very much more easily than if he had to handle a totally filled vial.

There is, however, a need for flexibility in the collected volume of eluate to avoid subsequent high dose operations such as dispensing or diluting highly radioactive eluate. It would be convenient to be able to collect the activity in a volume greater than 5 ml when this is desired. The two existing generators described above have each been modified to achieve this.

By using a larger vial, the single vial system can be designed in a manner allowing the technician to terminate the elution after 5 ml of to allow elution to continue further, effectively diluting the eluate already collected. A valve may achieve this, or the techician may intervene by removing the collection vial when it contains the required volume. Two problems arise. Firstly, the technician must be present, close to the high dose generator, so he can "move in" at the required time. Secondly, the vial, although only partially filled, has a void space, at very low pressure. It is not as easy task to remove aliquots of solution from such a vial without first carefully venting it in an aseptic manner. Such venting may be done after removal of the vial from the generator or, possibly, by incorporation of a venting device in the generator.

An alternative method of modifying the single vial system is to employ evacuated vials of different capacities and to allow complete elution to proceed. However, a multiplicity of collection vials and possibly vial shields are needed, and the problem of completely filled vials still remains.

Very recently yet another attempt to overcome the problems of handling these completely full vials has been made. Another commercial supplier now offers the option of using partially evacuated vials with which to elute their generator. These result in a partially filled vial of eluate at atmospheric pressure, but of course the volume of the eluate has been chosen not by the technician, but by the generator supplier.

Double vial systems achieve a measure of flexibility by filling the charge vials to different volumes. Again, the requirement for an increased number of different elution components presents complications for both the technician and the generator manufacturer.

Thus, it can be seen that there are advantages and disadvantages in both the single and double vial approaches. Simplicity in operation (single vial system) can incur problems for the technician in handling collection vials conveniently and in the need for additives in saline. However, when these problems are eliminated (double vial systems), other disadvantages, namely the need for more operations and components, are substituted.

SUMMARY OF THE INVENTION

In its preferred form, the present invention overcomes all of the above drawbacks, working with a single collection vial and allowing widely variable elution volumes to be collected in partially filled vials at atmospheric pressure.

The present invention provides a generator of radionuclides comprising a generator column containing the radionuclide and provided with an inlet and an outlet for eluent, a first reservoir for the eluent, a second reservoir to contain a variable pre-set volume of the eluent required for a single elution, means connecting the first and second reservoirs whereby the second reservoir can be filled up from the first, and means connecting the second reservoir to the column inlet whereby eluent can be caused to pass from the second reservoir through the column so as to elute the radionuclide therefrom.

The second reservoir is preferably provided with an aperture permitting the passage of air but preventing the escape of liquid. There are commercially available hydrophobic filters which perform this function.

Such a generator is particularly suitable for operation by vacuum elution, that is to say by connecting an evacuated vial to the outlet of the generator column so as to suck eluent from the second reservoir through the column. The provision of an aperture to the second reservoir, as noted above, can be used to cause air to be sucked through the generator column after the eluent, so as to dry the bed and leave the partly-filled vial at atmospheric pressure.

DETAILED DESCRIPTION OF THE PREFERRED EMBODIMENTS

Figure 1:
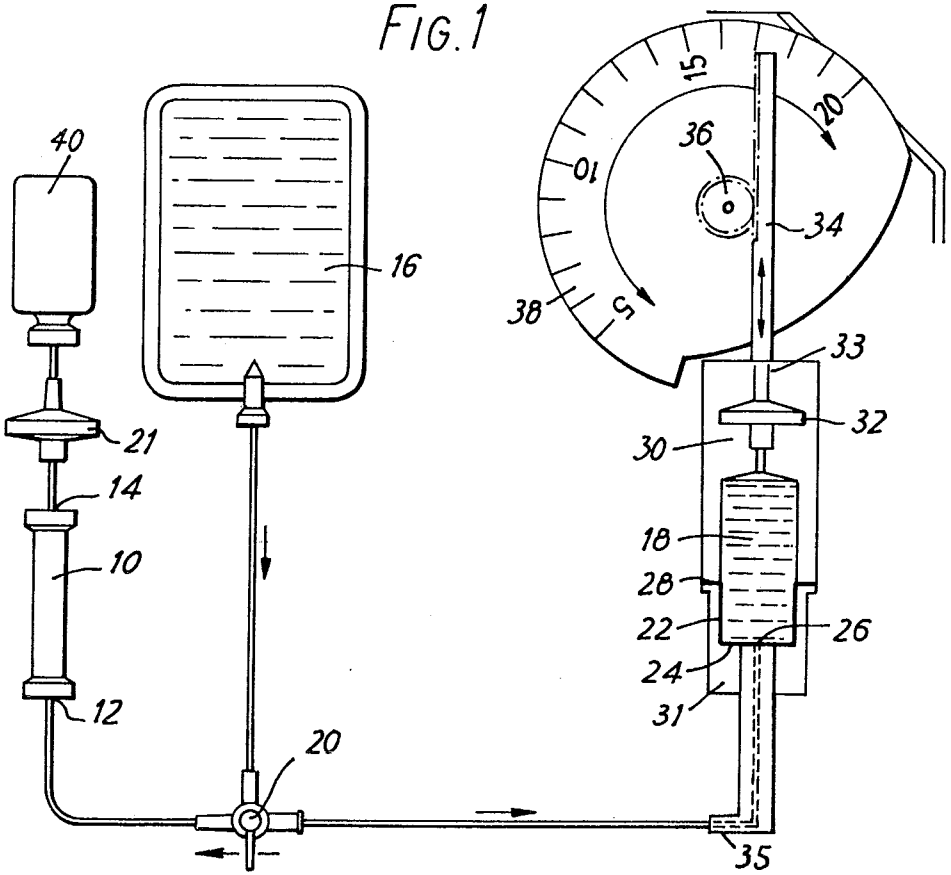
FIG. 1 of the accompanying drawings is a diagram of a generator according to the invention, showing a variable volume second reservoir at maximum volume.

Referring to FIG. 1, the generator comprises a column 10 of particulate alumina carrying molybdenum-99 adsorbed thereon, said column having an inlet 12 and an outlet 14 for eluent. A first reservoir 16 is a collapsible bag containing typically 250 ml of sterile physiological saline solution as eluent. There is a variable volume second reservoir 18, shown filled with liquid, which is described in more detail below. A three-way tap 20 and associated pipework can be arranged either to connect the first reservoir 16 to the second reservoir 18 (position A), or the second reservoir 18 to the column inlet 12 (position B). An outlet filter 21 is shown mounted downstream of the column outlet 14, but could be omitted if desired. A collection vial 40 is shown connected to the outlet of the column 10, but this would only be present part of the time.

The second reservoir 18 is of variable volume by virtue of a generally circular flexible diaphragm 22, whose centre portion 24 is fixed and carries an aperture 26 connected via a tube 35 to the three-way tap 20. The annular rim 28 of the diaphragm is clamped between two parts 30 and 31 of which part 30 has a cylindrical inner surface closed at the end remote from the diaphragm by a hydrophobic filter 32. This filter permits the passage of air via a tube 33 open to the atmosphere, but not of liquid. The part 30 has a rack arm 34 engaging a pinion 36 which is fixed to a circular dial 38 marked with volumes, from 5 ml to 20 ml in 1 ml divisions. Rotation of the dial 38 causes the parts 30 and 31 to move in a vertical direction and this has the effect of flexing the diaphragm 22. Movement of the parts 30 and 31 is limited, in both the upward and the downward directions by suitable stops (not shown).

The second reservoir 18 is defined by the upper surface of the flexible diaphragm 22, the cylindrical inner surface of the part 30 and the hydrophobic filter 32. The volume is variable, typically from 5 ml when the part 30 is in its lowest position and the diaphragm 22 is flexed in the shape of a hat the right way up (FIG. 2) to 20 ml when the part 30 is in its highest position and the diaphragm 22 is flexed in the shape of a hat upside down (FIG. 1).

Operation of the generator starts with the first reservoir 16 full, the second reservoir 18 empty, the tap 20 in position B and no collection vial on the column outlet and comprises the following steps.

1. The dial 38 is turned to the volume of eluent required, thus changing appropriately the volume of the second reservoir 18.

2. The tap 20 is turned to position A. Eluent flows by gravity from the first reservoir 16 and fills the second reservoir 18 up to the level of the filter 32, through which air escapes.

3. An evacuated collection vial 40, larger than the volume of eluate to be collected, is connected to the outlet 14 of the generator column 10. The vial must be sufficiently large not only to accommodate the selected volume of liquid but also to permit air to be drawn through the bed of the generator. FIG. 1 shows the generator at this stage in the operating cycle.

4. The tap 20 is turned to position B. Eluent is sucked from the second reservoir 18 through the column 10, where it picks up the available technetium-99m, and into the collection vial 40. When all the liquid has been sucked through, the collection vial is part full and still at a pressure below atmospheric. Air is sucked via the filter 32 through the column 10 until the collection vial is at atmospheric pressure. The air serves to dry the bed of particulate material on the column, and this helps to ensure a high yield of technetium-99m on the next elution.

5. The collection vial 40, partly filled with eluate and at atmospheric pressure, is removed.

Various modifications of the apparatus are possible.

(a) The second reservoir 18 could be given the variable volume feature in other ways, for example by being in the form of a bellows, rather than by having a flexible diaphragm.

(b) The filter 32 could be positioned above the level of the first reservoir 16. In that case, the eluent would in normal operation not contact the filter. In step 2, eluent would flow from the first to the second reservoir until the surface levels were the same.

The generator described has the following advantages:

(i) The elution volume is easily variable through a wide range.

(ii) Elution is automatic; the operator does not have to be present.

(iii) The collection vial is only partly filled with liquid.

(iv) The collection vial is at atmospheric pressure on completion of the elution process.

(v) The column bed is dried after elution; undesirable additives are not required in the eluent.

(v) Only one size of collection vial and shield are required.

(vii) The generator column can be specially designed for activity to be elutable in a small volume.

(viii) The design is flexible in that, should there be users who do not require the features provided by this invention, the manufacturer has the option of supplying such users with a cheaper conventional generator by omission of the components to the right of tap 20 and closure of the right hand orifice of that tap.

Figure 2:
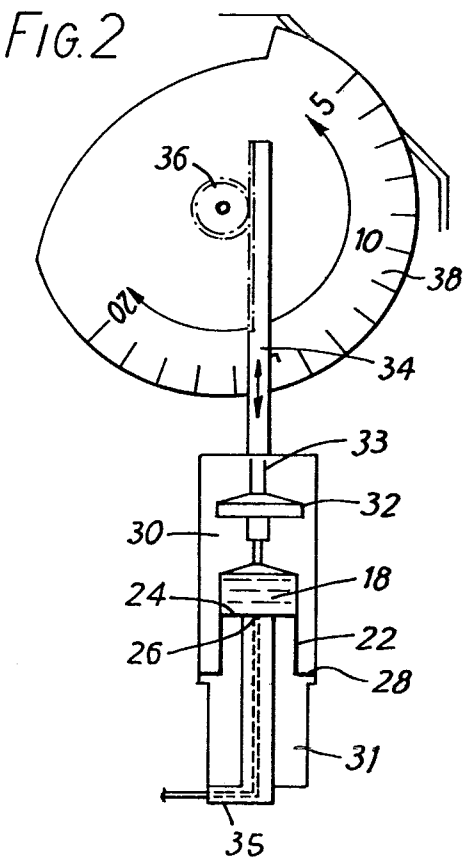
FIG. 2 is a diagram of part of the generator of FIG. 1, showing the second reservoir at minimum volume.
Figure 3:
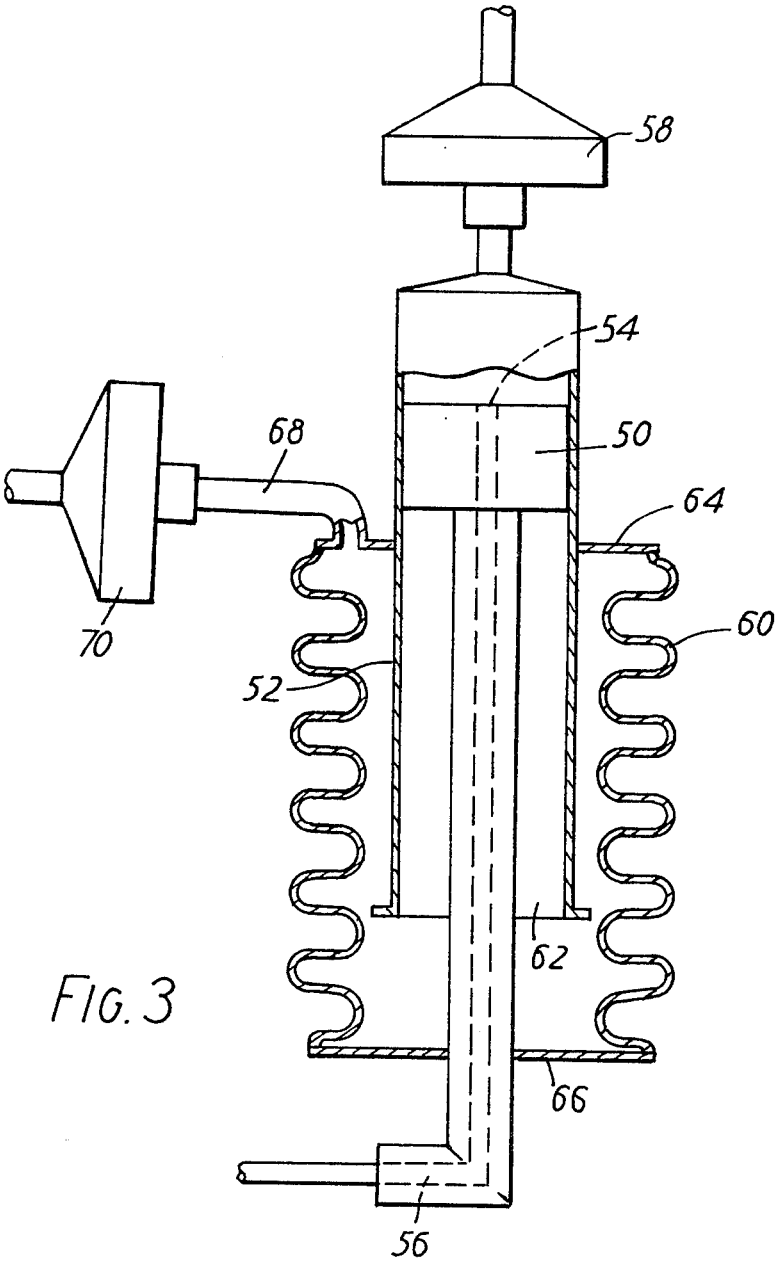
FIG. 3 is a diagram of a part of a different generator according to the invention, showing a variable volume second reservoir.

FIG. 3 shows an alternative design of second reservoir to that shown in FIG. 2.

Referring now to FIG. 3, a second reservoir 48 is defined by the piston 50 and the cylinder 52 of a syringe. The piston 50 is fixed and carries an aperture 54 connected by a tube 56 to the three-way tap 20 shown in FIG. 1. The cylinder 52 is closed at the end remote from the piston by a hydrophobic filter 58, which permits the passage of air but not of liquid. The cylinder 52 can be moved up and down, mutually or mechanically, on the piston 50, so as to alter the volume of the second reservoir 48.

A bellows 60 surrounds the open lower end 62 of the cylinder 52. One end 64 of the bellows 60 is mounted on the outside of the cylinder 52, and the other end 66 is mounted on the tube 56. A vent 68 with a bacterial filter 70 is shown, but might be omitted if the bellows were very floppy.

The purpose of the bellows 60 is to prevent bacterial contamination of the second reservoir 48 via the open end 62 of the cylinder 52. If sterility of the eluate is not important or can be ensured in some other way, then the bellows 60 could be omitted.

We claim:

1. A generator of radionuclides comprising a generator column containing the radionuclide, provided with an inlet and an outlet for eluent, a first reservoir for the eluent, a second reservoir for receiving a variable pre-set volume of the eluent required for a single elution, means, connecting the first and second reservoirs, for filling up the second reservoir from the first, the second reservoir including means for varying the volume thereof so as to receive the variable pre-set volume of the eluent from the first reservoir through the filling up means, and means, connecting the second reservoir to the column inlet, for passing eluent from the second reservoir into the column so as to elute the radionuclude therefrom.

2. A generator as claimed in claim 1, wherein the column contains molybdenum-99 in order to generate technetium-99m.

3. A generator as claimed in claim 1, further comprising a three-way tap connecting the first reservoir, the second reservoir, and the column inlet.

4. A generator as claimed in claim 1, wherein the second reservoir is provided with an aperture permitting the passage of air but preventing the escape of liquid.

5. A generator as claimed in claim 4, wherein the second reservoir is provided with a hydrophobic filter permitting the passage of air but preventing the escape of liquid.

6. A generator as claimed in claim 1, including an evacuated vial connected to the outlet of the generator column.

7. A generator as claimed in claim 6, wherein the capacity of the evacuated vial is greater than the volume of the second reservoir.

8. A method for generating a radionuclide using a generator which includes a generator column containing the radionuclide and provided with an inlet and an outlet for eluent, a first reservoir for the eluent, a second reservoir having means for varying its volume to contain a variable pre-set volume of the eluent required for a single elution, means for connecting the first and second reservoirs such that the second reservoir can be filled up from the first, and means for connecting the second reservoir to a column inlet such that eluent can be caused to pass from the second reservoir through the column as to elute the radionuclide therefrom, the method comprising the steps of:

filling up the second reservoir with a pre-set volume of eluent from the first reservoir, and then connecting an evacuated vial to the outlet of the generator column so as to draw the eluent from the second reservoir through the column and into the evacuated vial.

9. A method as claimed in claim 8, wherein the volume of the evacuated vial is greater than the pre-set volume of eluent in the second reservoir, the method further comprising the step of drawing air through the column and into the vial by the partial vacuum in the vial so as to substantially dry the column and bring the vial to atmospheric pressure after the eluent has been drawn into the evacuated vial.

10. A method as claimed in claim 9, wherein sterile air is drawn through the second reservoir through the column and into the vial.

* * * * *